United States Patent [19]

Katz

[11] 4,372,364

[45] Feb. 8, 1983

[54] DOOR PROTECTOR

[76] Inventor: Edward R. Katz, 4847 Cambridge Dr., Dunwoody, Ga. 30338

[21] Appl. No.: 319,207

[22] Filed: Nov. 9, 1981

[51] Int. Cl.[3] ..... E06B 7/28

[52] U.S. Cl. ..... 150/52 R

[58] Field of Search ..... 150/52 R; 49/460

[56] References Cited

U.S. PATENT DOCUMENTS 1,669,616 5/1928 Johnson ..... 150/52 R

*Primary Examiner*—Donald F. Norton

*Attorney, Agent, or Firm*—Newton, Hopkins & Ormsby

[57] ABSTRACT

A door protector for use by furniture movers is disclosed which fully protects all main entrance doors from damage due to contact with moving furniture. The use of the protector allows speeding up of the moving process. The protector is an adjustable length pad which fully covers the exposed surface of the door and affords double thickness protection at the lower end portion of the door. The protector is hung removably on the door by an upper end pocket which engages over the top edge of the door to support and position the protector. Damage to furniture is also avoided by using the door protector.

8 Claims, 3 Drawing Figures

DOOR PROTECTOR

BACKGROUND OF THE INVENTION

The furniture moving industry has a tendency to lag in terms of technology by adhering to traditional practices which are frequently inefficient and costly. One example of such technology lag in the industry is the continued usage of quilted pads which are applied randomly over larger pieces of furniture in a moving van. Such pads are seldom used on the furniture after it leaves the moving van and is placed on furniture dollies for movement into or out of a building. Such movement frequently results in damage to the furniture and/or building surfaces due to careless or inadvertent contact. Since all furniture must pass through the main entranceway of a building during a move, the main entrance door is generally the most severely damaged area.

Accordingly, the object of the invention is to deal directly, effectively and economically with this particular problem by means of a door protector pad which is entirely practical and convenient to use and relatively inexpensive to manufacture. Its use by the mover will eliminate the single most frequent cause of damage, namely, damage to the main entrance door and damage to furniture passing such door due to contact. The use of the door protector, according to the invention, allows the furniture mover to safely speed up the movement of furniture through the entrance doorway without fear of damaging the door or furniture. If some contact takes place, the protector pad will avoid damage to the door or to the furniture. The device is adjustable lengthwise to readily fit doors of different heights and this adjustment provides a double thickness padded area at the bottom of the door where the severest damage due to collision is most likely. The protector is extremely simple in its construction and use and does not burden the furniture mover of interfere in the slightest with his regular routine. It simply offers a very economical way to eliminate one of the greatest causes of damage arising from the movement of furniture into or out of a home or other building.

Other features and advantages of the invention will become apparent during the course of the following detailed description.

DETAILED DESCRIPTION

Figure 1:
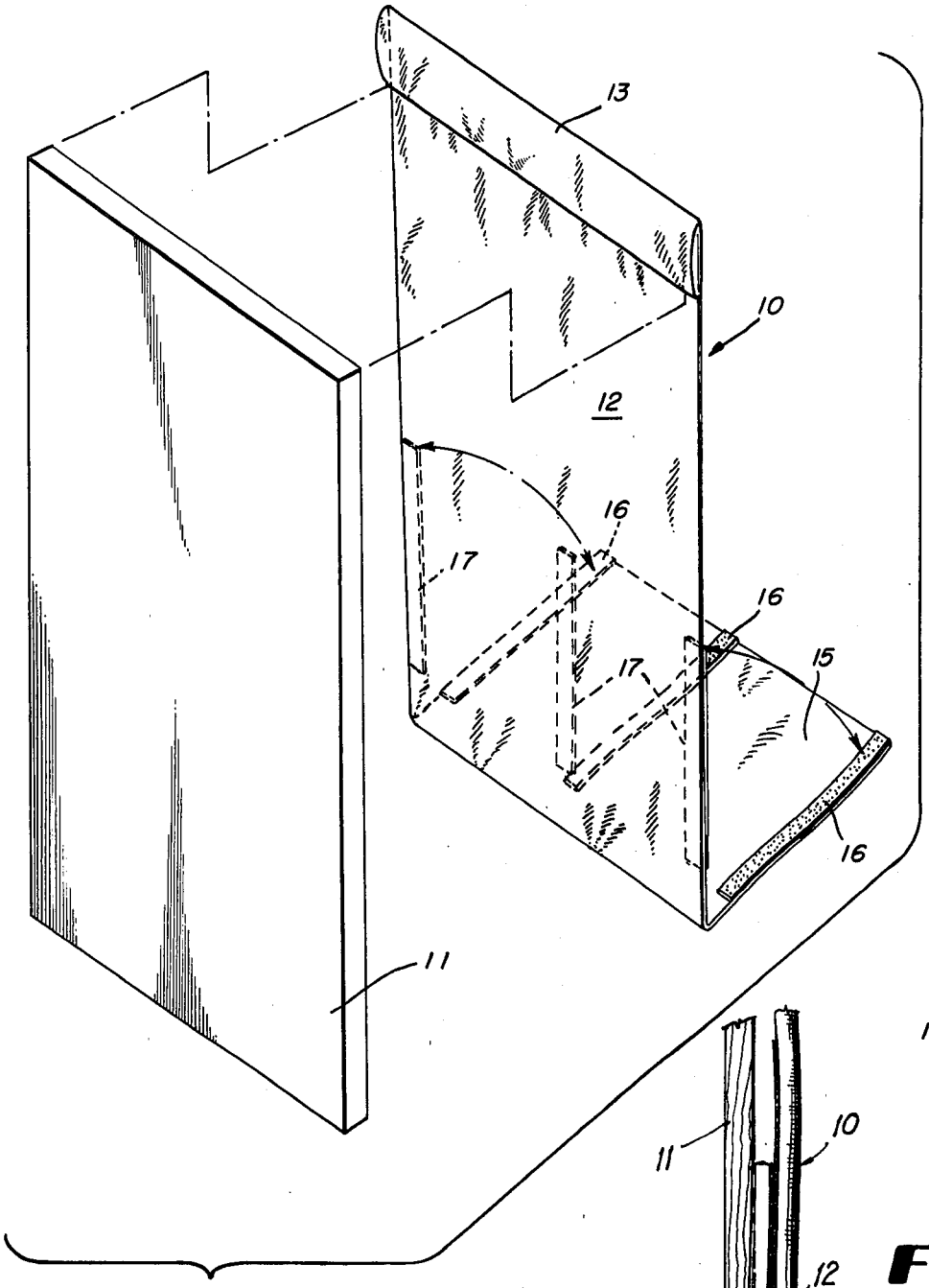
FIG. 1 is a perspective view of a door protector shown in relation to a main entrance door on which it is used.

Referring to the drawings in detail wherein like numerals designate like parts, the numeral 10 designates a door protector in its entirety adapted for application particularly to a main entrance door 11 but usable on other doors as well when needs dictate such use. The protector 10 is a unitary device which includes a rectangular body portion 12 adapted to cover the exposed side of the door 11 when furniture is being moved through the doorway. At its upper end, the body portion 12 has integrally attached thereto a short transverse pocket 13 which is closed at its top edge and downwardly open as indicated at 14 to receive in the pocket the top edge portion of the door 11. The pocket 13 serves the dual purpose of supporting the weight of the protector 10 and locating the protector laterally or transversely on the door 11 to assure that the entire exposed surface of the door is covered. Since the ends of the pocket 13 are closed and fitted, this transverse locator or positioning feature is inherently provided in the protector.

Figure 2:
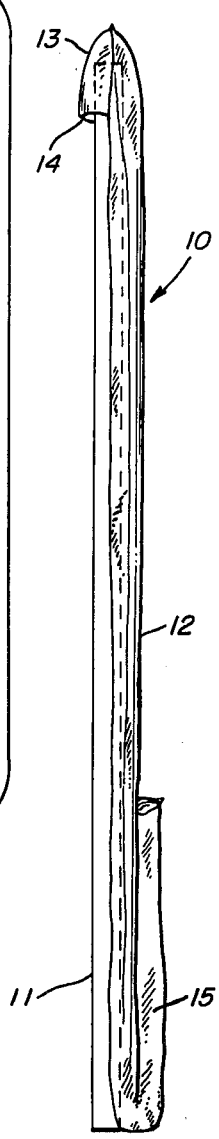
FIG. 2 is an edge elevation of the protector in assembled relationship with a main entrance door.

To accommodate doors of different heights, excess length is provided at the bottom of the body portion 12 designated by the integral extension 15 or flap in the drawings. This flap can be folded upon the lower part of the body portion 12 in the appropriate manner shown in FIG. 2 to adjust the length of the protector to fit the height of any door. An advantage of this adjustment shown clearly in FIG. 2 is the provision of a double thickness pad near the bottom of the door to provide increased protection from collision with furniture, furniture dollies or other moving objects.

To secure the flap 15 in folded relationship to the body portion 12, mating Velcro strips 16 and 17 are attached to the flap 15 and body portion 12 in spaced relationship, as shown in FIG. 1. The strips 16 and 17 are of sufficient length to enable full adjustment of the flap 15 lengthwise of the body portion 12. The strips 16 extend from the bottom edge of the protector upwardly for a distance of about 18 inches, more or less, while the strips 17 of approximately the same length may be spaced from the strips 16 lengthwise, as shown in FIG. 1, or may be continuations of the strips 16, if preferred.

The protector 10 has an enclosed cotton fill to provide adequate padding. Other equivalent padding material may be used. Its exterior is formed from tough flexible sheet material, such as canvas or equivalent material. The cotton fill is completely enclosed by the outer sheeting and cannot escape to the exterior of the protector. Conventional techniques can be employed in manufacturing the protector which is flexible and therefore very easy to manipulate.

The use of the door protector 10 requires only an instant for the mover to place the pocket 13 over the top edge of the door and then to fold up and secure the flap 15 to establish the desired length of the protector. The furniture mover can proceed with his work at much greater speed than usual without the fear of damaging the door or the furniture if some accidental contact takes place.

Figure 3:
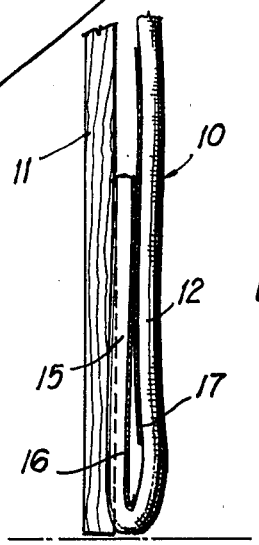
FIG. 3 is an edge elevation of a second embodiment of the protector.

FIG. 3 illustrates the second embodiment of the door protector 10 wherein the flap 15 is positioned between the door 11 and the body portion 12. The flap 15 is held in position by strips 16 and 17. This securing of the flap 15, as opposed to that shown in FIGS. 1 and 2, helps to prevent the door protector 10 from snagging on any furniture or other objects being moved through the doorway passage.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A door protector to prevent damage caused by contact with moving furniture or the like comprising a flexible padded body portion of sufficient size to cover one side of a door substantially from side-to-side and top-to-bottom, and pocket means carried by one end of said body portion and being engageable with the top edge portion of a door for the purpose of suspending the protector on the door and positioning it laterally relative to the door.

2. A door protector as defined in claim 1, and the body portion including an excess length extension at its lower end forming a flap adapted to be folded onto one side of the body portion to adjust the length of the protector to fit doors of various heights, and means on the body portion and said flap to secure the flap in folded relationship with the body portion to form a double thickness portion on the protector at the lower end portion of the door to which the protector is applied.

3. A door protector as defined in claim 2, and said means comprising mating separable fastener components on the flap and body portion.

4. A door protector as defined in claim 3, and said fastener components comprising spaced parallel Velcro strip components on the flap and body portion and being elongated longitudinally of the protector.

5. A door protector as defined in claim 1, and said pocket means comprising a single short downwardly open pocket carried by the top of the body portion and extending transversely and continuously across the full width of the protector.

6. A door protector as defined in claim 5, and a foldable adjustable length extension on the lower end of the body portion enabling the length of the protector to be adjusted and forming on the protector a double thickness pad at its lower end portion.

7. A door protector as defined in claim 6, and fastener means on said extension and body portion operable to hold the extension in folded relationship against one side of the body portion.

8. A door protector as defined in claim 6, and said flexible padded body portion having an exterior formed from a tough flexible sheet material, and padding within the interior of the sheet material and being entirely enclosed therein so that the entire protector constitutes a soft protective cushioning pad.

* * * * *